US008187357B2

(12) United States Patent
Meyn

(10) Patent No.: US 8,187,357 B2
(45) Date of Patent: May 29, 2012

(54) MELTING METALLURGICAL PROCESS FOR PRODUCING METAL MELTS AND TRANSITION METAL-CONTAINING ADDITIVE FOR USE IN THIS METHOD

(75) Inventor: Ulrich Meyn, Elmshorn (DE)

(73) Assignee: M.K.N. Technologies GmbH, Ratingen (DE)

( * ) Notice: Subject to any disclaimer, the term of this patent is extended or adjusted under 35 U.S.C. 154(b) by 889 days.

(21) Appl. No.: 12/059,089

(22) Filed: Mar. 31, 2008

(65) Prior Publication Data

US 2008/0236334 A1 Oct. 2, 2008

(30) Foreign Application Priority Data

Mar. 29, 2007 (DE) ..... 10 2007 015 585

(51) Int. Cl.
*C22B 4/06* (2006.01)
*C22B 9/16* (2006.01)

(52) U.S. Cl. ..... 75/10.46; 75/10.65; 75/414

(58) Field of Classification Search ..... 75/300, 75/303–329, 10.1–10.18, 10.39–10.61, 10.65, 75/10.66, 414, 433, 500–502, 507, 513–523, 75/526–531, 533–580, 600, 603, 604, 649–652, 75/680–686

See application file for complete search history.

(56) References Cited

U.S. PATENT DOCUMENTS

| | | | | |
|---|---|---|---|---|
| 3,684,491 | A | 8/1972 | Coffield et al. | |
| 3,898,076 | A * | 8/1975 | Ranke | 149/4 |
| 4,426,224 | A | 1/1984 | Shimme et al. | |
| 4,487,628 | A | 12/1984 | Bjorling | |
| 4,919,714 | A | 4/1990 | Sugiura et al. | |
| 5,749,939 | A * | 5/1998 | Kundrat | 75/560 |
| 2004/0213717 | A1 | 10/2004 | Akahoshi | |

FOREIGN PATENT DOCUMENTS

| | | | |
|---|---|---|---|
| DE | 1964092 | | 7/1970 |
| EP | 0583164 | A1 | 2/1994 |
| FR | 2519024 | | 7/1983 |
| GB | 2141739 | * | 1/1985 |
| JP | 05125425 | A | 5/1993 |
| WO | 97/20954 | A1 | 6/1997 |
| WO | 03/018850 | A1 | 3/2003 |
| WO | 2005/098054 | A1 | 10/2005 |
| WO | 2006/089358 | A1 | 8/2006 |
| WO | 2006/131764 | A1 | 12/2006 |

* cited by examiner

*Primary Examiner* — Scott Kastler
*Assistant Examiner* — Vanessa Luk
(74) *Attorney, Agent, or Firm* — Panitch Schwarze Belisario & Nadel LLP

(57) ABSTRACT

The invention relates to a process for producing a metal melt containing at least one base metal and at least one further alloy constituent, wherein the production takes place in a melting vessel with slag covering the melt. In accordance with the invention, for increasing the content of the alloy constituent of the melt, an additive is fed to the melt which contains said alloy constituent at a content of ≧5-10 percent by weight of the alloy constituent, ≧5-10 percent by weight of melting metallurgically harmless volatile matter, ≦5 percent by weight of sulfur and possibly fractions of further alloy constituents and/or slag formers. The additive is obtainable by ore leaching and by precipitation in the form of hydroxides and/or carbonates. The invention also relates to such an additive.

21 Claims, 1 Drawing Sheet

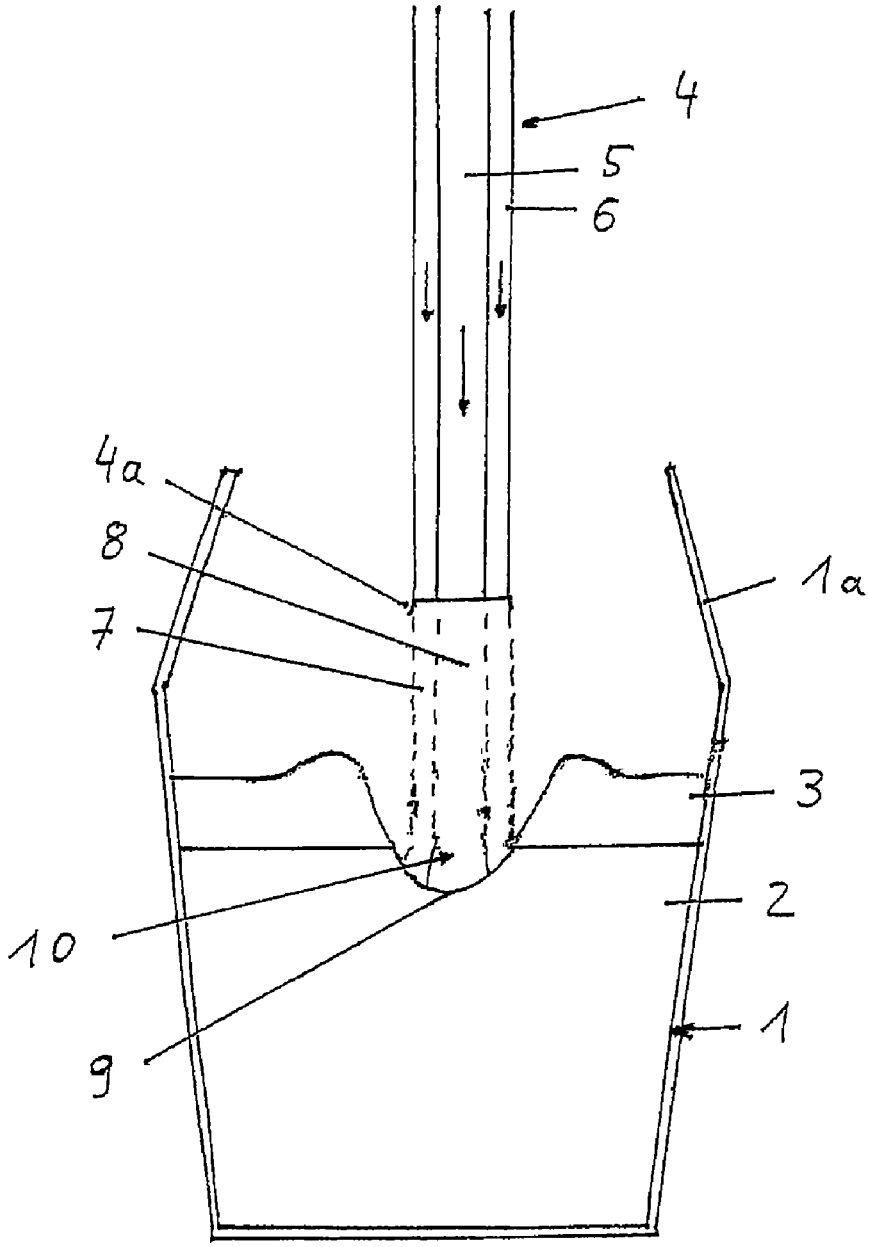
4
5
6
4a
8
7
1a
3
2
10
1
9

MELTING METALLURGICAL PROCESS FOR PRODUCING METAL MELTS AND TRANSITION METAL-CONTAINING ADDITIVE FOR USE IN THIS METHOD

The invention relates to a melting metallurgical process for producing a melt with at least one base metal and at least one additional alloy constituent in a melting vessel, wherein the melt is covered with a slag. The invention further relates to a transition metal-containing, especially nickel and/or cobalt-containing additive for producing nickel and/or cobalt-containing alloys, wherein said additive is present in the form of a solid and is suitable for being used in the process according to the invention.

For the production of iron alloys or steels which are enriched by certain alloy constituents, it is mostly required to add alloy constituents to the melt, in order to adjust the composition of the melt. Such constituents may be in particular nickel, cobalt, but also vanadium, molybdenum etc. For adjusting the composition of the melt ferroalloys like ferronickel, ferrocobalt etc. are used, but also oxidic components like NiO or also nickel ores like laterite which have a corresponding nickel content. However, the addition of these components respectively includes certain drawbacks.

For instance the provision of ferroalloys for the adjustment of the content of the alloy constituents in the melt is relatively expensive and requires high amounts of energy. The use of oxidic minerals for the adjustment of the composition of the melt includes the drawback that high efforts are often required for removing undesired impurities like undesired trace elements such as phosphorus, tin, arsenic, or in particular steels also cobalt, molybdenum etc. from the ores. Even by enrichment processes like flotation processes such impurities cannot always be removed to the desired extent. If undesired constituents like phosphorus, sulfur etc. are introduced into the melt through said ores, this will result in high efforts for removing the same from the melt, for instance by a suitable slag treatment, by using several different slags and the like. Moreover, the introduction of ores into the metal melts also leads to other problems, especially with regard to kinetics and to the extent of the formation of crystallization germs, because when using ores the particles of the additives are not always dissolved in the melt fast enough and completely, so that the same may have negative effects on the melting metallurgy. Furthermore, the introduction of oxidic ores into the melt causes a negative contribution to the energy balance, because the melting of the ores is strongly endothermic. This may lead to considerable process-technological and metallurgical problems, for instance also to an increased slagging of alloy constituents like chromium. Which elements will become slagged, essentially depends on the thermal conditions at the time of carrying out the process.

It is further known to directly add oxides like nickel oxide, but the above-mentioned problems will arise also in this case. In addition, nickel oxide is toxic and cancer-causing, so that the use thereof should be avoided.

In view the above, the invention is based on the problem of providing a simple and inexpensive process, which allows a simple metallurgical control, for producing metal melts which are enriched by alloy constituents and which are preferably covered with a slag and perform a mass transfer with said slag. The problem of the invention further resides in the provision of an additive which may be used particularly advantageously in such process and which can be produced at low cost.

This problem is solved by the provision of a method according to claim 1 and an additive according to claim 15.

In accordance with the method of the invention additives are used which contain the alloy constituent to be enriched and a high content of volatile matter that is harmless from the melting metallurgical aspect, such as especially water and/or carbonate having low sulfur contents and compared to the use of ores low contents of slag formers such as calcium and/or magnesium oxide etc. as well as high contents of the respective alloying constituent. The water may be present especially and at least substantially or practically exclusively as a chemically bound water in the form of crystal water and/or hydroxide groups. Such additives may be obtained especially by the processing of ores, for instance by leaching laterite ores, provided that the constituents to be alloyed are nickel and/or cobalt. If necessary, these leachings can be reworked, in order to separate further undesired constituents, and where appropriate the desired alloy constituents may also be separated from these leaching by precipitation. The respective precipitates may then be separated and dried, especially for obtaining additives which may be transported pneumatically or by gravity. If necessary, the additives that have been obtained in this way may be calcinated or pre-calcinated in a separate step for reducing the content of the constituents volatilizing during adding the additive to the melt, such as chemically bound water, e.g. in the form of crystal water, and/or hydroxide groups and/or carbonate, without this being necessary all the time. The content of undesired constituents which are neither alloy constituents nor constituents which volatilize during adding the additive to the melt nor slag formers may be ≦15-20 percent by weight, ≦5-10 percent by weight or also ≦2-3 percent by weight, referred to the additive which is used.

Surprisingly it turned out that such additives having a very high content of constituents which volatilize in the melt during supplying the additive to the melt can be used in such processes and offer advantages such as the production of relatively pure melts, metallurgical advantages such as only little slagging of other alloy constituents, low production cost of the respective melt and of the materials produced from it. Surprisingly it was found that such processes are controllable despite the effects that occur with the calcination of the supplied additives, such as the generation of huge amounts of water steam or other volatile gases like $CO_2$. This particularly applies when the additive is supplied from the upper region of the melting vessel, i.e. from the side of the slag. The process according to the invention may be especially applied where iron is the base metal of the melt, i.e. the main alloy constituent of the same, or where the melt normally contains ≧10-20 percent by weight of iron or is ferrous, but also for other base metals which can normally be transition metals. The method is particularly suited for the production of steels, including low, medium and high alloy steels. The steels preferably have a high carbon content, e.g. ≧1.5 percent by weight, ≧1.75-2 percent by weight or ≧2.25-2.5 percent by weight or ≧2.75-3 percent by weight of carbon, referred to the carbon content of the melt into which the additive is introduced or referred to the final product of the respective steel production method as performed in the respective melting vessel. The nickel content of the resulting melt after stopping the addition of a nickel-containing additive may be ≧1.5-1.75 percent by weight, ≧2-2.75 percent by weight or ≧3-4 percent by weight, e.g. approx 5 percent by weight or higher. The process according to the invention may be further used preferably in the production of Cr—Fe or Cr—Fe—Ni pre-alloys which may have a chromium content of ≧30-35 percent by weight, ≧40-45 percent by weight or ≧45-50 percent by weight of chromium, wherein the carbon content of the melt in the process step of adding the additive according to the invention or of the final product may be ≧2-3 percent by weight, ≧3.5-4 percent by weight or ≧4.5-5 percent by weight, and wherein the melt is preferably produced in a converter process. The carbon content mostly amounts to ≦8-10 percent by weight. Through the method according to the invention mostly a decarburization of the melt takes place. Hence, the additive addition according to the invention is mostly effected during a decarburization process performed by means of a blowing lance or during a refining process or directly before or after the same.

Normally the additive addition according to the invention is preferably effected during a main decarburization phase of the respective process of steelmaking or of making the respective alloy. Accordingly, the additive that is used in accordance with the invention is preferably supplied to melts which still have to be decarburized, with a partial decarburization taking place during the additive supply.

Preferably, the additive to be alloyed is introduced into the respective upper space of the melting vessel or converter, i.e. from above the slag which covers the melt, with the additive outlet of the feeding device being preferably spaced from the slag, so that the additive has to take its way through the atmosphere towards the slag or towards the melt.

Preferably, the additive which is present as a solid material is directly supplied inside the metal melt, by means of a gas stream under the production of a slag-free burn spot of the metal melt. This particularly applies to the use of Ni and/or Co-containing additives, but in case also to other transition metals, especially V, Mo. Accordingly, the burn spot of the metal melt (melting bath surface) is produced by the fact that the slag is completely displaced by the gas stream on the place where it impinges, so that the additive—in consideration of its calcination during feeding from the feeding device to the melt—can directly contact the metal melt, without being required to pass through the slag. In this case it proved advantageous with regard to the melting metallurgical trans-formation of the additive and the alloy for the burn spot to have temperature which is a high as possible, for example from ≧1,750° to 1,800° C., preferably ≧2,000° to 2,200° C. or ≧2,400° to 2,500° C., and even more preferably temperatures of ≧2,600° C. Due to these very high burn spot temperatures (i.e temperatures of the melt in the burn spot) the incorporation of the alloy constituents from the additive into the melt is extremely fast.

The calcination of the additive can be controlled especially by the conveying speed of the additive towards the melt in such a way, that the same takes place only at the time of or after the discharge from the feeding device which is mostly designed as a lance. In this case, the calcination may take place partially or predominantly during the transfer of the lance to the melting surface, but also for a significant part or a predominant part in the burn spot (i.e. the melting surface that has been exposed by the nozzle-injection) or in the impact zone of the supplied additive on the melting bath where the melting bath forms a hollow. The endothermic calcination processes of the additive accordingly take place prior to the entry of the additive into the melt or directly in the burn spot or in the impact zone, so that an extremely fine dispersion of the additives takes place during the calcination and prior to their absorption by the melt. Thus the calcination gases penetrate into the metal melt only to a very small extent or practically not at all, and a calcination of the additive in the nozzle region, i.e. before leaving the lance nozzle or the like is avoided. All in all, the energy budget of the production process is controllable much better, which fact also provides advantages concerning the process management, especially also with regard to the avoidance of slagging of certain alloy constituents like for instance chromium and with regard to the metallurgy of the melt in terms of crystallization germs introduced through the calcination of the additive. This is true for instance also with regard to a possible nozzle-injection of the additives by below-bath-nozzles which penetrate into the melt below the slag.

The additive containing the alloy elements is supplied to the melt preferably in a solid material stream which is surrounded by a gas stream. It is possible thereby to effectively prevent the formation of a burn spot in the melt and an interaction or a chemical reaction with the slag. At the same time the solid material stream may be focused or adjusted in its diameter. Further, due to the gas jacket the penetration depth of the additive into the metal melt or the location of the calcination can be controlled independently of the solid material supply, and/or the escaping of dusts like for instance nickel oxide dusts from the solid material stream can be prevented. Moreover, volatile constituents like $H_2O$, $CO_2$ and the like which are produced during the calcination are prevented from escaping, which fact is desired in certain process managements. The surrounding of the solid material stream by the gas or the conveying gas stream accordingly takes place preferably from the feeding device, especially a gas lance, up and into the burn spot. Preferably, the conveying device or the lance is cooled, especially water-cooled. If need be, the surrounding gas may simultaneously be the conveying gas for the solid material stream. Preferably, the conveying gas is inert with respect to the additive, at least until it exits from the feeding device, e.g. a lance, or it is completely inert under the conditions of the process. The conveying gas may be air, preferably air that is enriched by nitrogen or other inert gases, or it may be directly nitrogen or a different inert gas like argon. Preferably, the conveying gas does not exhibit an oxygen content which is increased compared to air.

The lance may include in a manner known per se a central tube for feeding solid materials and on the radial outside thereof a further tube which is arranged coaxially and has a larger diameter, or it may include a preferably substantially circular arrangement of several outlet nozzles for the enveloping gas. The outlet nozzles of the solid material stream and/or the enveloping gas may be formed in particular as Laval nozzles. The conveying gas which is possibly used leaves the central tube together with the solid materials. The lance may also include a water-cooled jacket.

The device for feeding or nozzle-injecting the additives according to the invention by nozzles may be constructed in the fashion of a closed system, so that any human contact with the material is avoided. This is important above all in the case of nickel-containing additives. In a pneumatic system a silo may be loaded by a conveying means assisted by pressurized air, and the dusts may be further fed by pressure vessels of the feeding device or the lance. The additives leaving the lance are enveloped by a gas stream, in order to minimize losses of additives also in this case.

Besides, due to the fact that the calcination of the additives is controlled in such a way that the same takes place at the time of or after leaving the feeding device or lance (but preferably not before), the existing exhaust heat from rising exhaust gases and radiation heat from the bath as well as from the surrounding walls of the melting vessel or the converter may be utilized for the calcination of the additives.

In certain metallurgical manufacturing processes the endothermic effect which results from the calcination may be selectively utilized also deliberately, in order to reduce the bath temperature. To this end, the oxygen-containing enveloping gas and/or the conveying gas for instance may be replaced partially or entirely by inert gases. The strongly exothermic decarburizing reaction which takes place as a result of the reaction of the oxygen-containing gases with the carbon of the melt, will then remain partially or completely undone. It will be understood, that the gas supply may be performed also in a way such as to thereby effect a control of the temperature of the melt in a predetermined process, in which process the oxygen content of the enveloping gas and/or of the conveying gas is varied in a different location, in dependence of process parameters of the manufacturing process, such as for example the burn spot temperature and/or the temperature of the melt. According to demand, the oxygen content of the conveying and/or enveloping gas may be increased and the contents of inert gases decreased or vice versa. Hence, the additive to be used in accordance with the invention may be supplied to the melt during the refining phase of the metallurgical process, especially during the main refining phase.

The enveloping gas stream may contain ≧25 percent by weight or ≧50 percent by weight or ≧75 percent by weight of oxygen, in certain variants of the process permanently or temporarily also ≧80 percent by weight, ≧90 percent by weight or ≧95 percent by weight or also ≧98 percent by weight of oxygen, or the enveloping gas stream may practically be pure oxygen. The oxygen content of the enveloping gas stream may be ≦95 to 98 percent by weight, where appropriate ≦80 to 90 percent by weight or also ≦60 to 70 percent by weight, where appropriate also ≦50 or ≦25 percent by weight. The oxygen content of the enveloping gas and also of the conveying gas may be adjusted by the use of inert gases for example to ≦10 to 20 percent by weight or ≦5 percent by weight of the gas, or practically pure inert gases may be used. The inert gas to be used is dependent on the respective conditions of the process; it may be nitrogen for instance, preferably argon. Since also the bath temperature decreases due to the strongly endothermic calcination reaction of the used additives including high fractions of volatile calcination components and since the volatile calcination products like e.g. water steam and/or $CO_2$ or reaction products of the same like oxygen, hydrogen and CO cause a reduction of the partial pressure of the oxygen and/or of the reaction products in the burn spot, it is possible in accordance with the process of the invention to also dispense with the admixing of inert gases for controlling the bath and/or burn spot temperature.

Preferably, the conveying gas and/or the enveloping gas have a composition such that the same is inert also with respect to the calcination of the intermediate substance, i.e. that no or only a secondary reaction of the conveying and/or enveloping gas with the intermediate substance and/or with its calcination products takes place or that no or practically no reaction heat is released. This should preferably generally apply to the time period prior to the exit of the additive from the feeding device, e.g. a lance.

Together with the at least one additive which contains at least one further alloy constituent, additional solid materials may be fed to the melt if needed, for instance further alloy constituents which may be of the conventional type like ferroalloys, and/or slag-forming substances like calcium and/or magnesium compounds (e.g. CaO, MgO, dolomite etc.), silicates or quartz, without being limited thereto. The content of these further solid materials in the additive stream may be ≦50 percent by weight, preferably ≦20-25 percent by weight or ≦10-20 percent by weight, in particular also ≦5-9 percent by weight or ≦2-4 percent by weight. Where appropriate the additive stream may be free of such additional solid materials.

The stream of additives supplied to the melt may include further solid materials or constituents like for instance carbons, hydrocarbons in a solid, liquid or gaseous form or other reduction agents like for instance ferrosilicon, aluminium, ferroaluminium etc. Preferably however, the additive to be alloyed contains ≦10 percent by weight or ≦5 percent by weight of such solid materials or reduction agents, preferably ≦2 to 3 percent by weight or ≦1 percent by weight. The stream of additives, in case inclusive of gaseous components contained therein, and/or the enveloping gas stream may also be free of (particle-shaped) carbon, hydrocarbons and/or other reduction agents. Hence, the lance which is used for feeding the additives does not act or act only to a minor extent as a kind of a burner, and possible reactions shall take place outside of the lance.

The additive which is used and which may exhibit a high content of chemically bound water may be suitably prepared for the pneumatic conveyance and/or conveyance by gravity. The content of free, merely physically bound water (residual humidity) may in this case amount to ≦5 percent by weight, preferably ≦2-3 percent by weight or ≦1 percent by weight, referred to the total weight of the additive. Where appropriate other ways may be chosen for implementing the conveying or feeding to the melt.

The additive may consist for ≧60-70 percent by weight, ≧75-80 percent by weight or ≧85-90 percent by weight or also ≧95 percent by weight from the constituents (1) alloy constituents desired for the intended use, (2) volatile matter without melting metallurgical properties, and (3) slag formers.

The additive which is used and which is present in the solid form may have an average or maximum grain size of ≦10 mm, ≦3-5 mm or the like, and where appropriate it may also be present in a more finely dissipated form like in the form of a powder, e.g. with grain sizes of ≦0.5-1 mm, or in the form of dusts. If necessary, the additive may be also pre-sent in the compacted or agglomerated form, e.g. in a briquetted, pellet or granulated form, wherein the briquettes, pellets etc. are able to burst and to finely dissipate unaided, due to the calcination reaction and the vaporization of water and/or $CO_2$ during feeding thereof to the burn spot.

The method according to the invention may particularly be an AOD process. The melting vessel may be an argon-oxygen-decarbonizer, a Creusot-Loire-Uddeholm (CLU) converter, a vacuum-oxygen (VOD) converter, or a Cr-converter. Where appropriate the melting vessel may be a BOP or Q-BOP converter. Possibly, though less preferably, the process may be an electro-steel-process, for instance an electro light arc furnace process.

The alloy constituents that must be brought in for adjusting the composition of the melting bath may be supplied for ≧5-10 percent by weight or ≧20-25 percent by weight, ≧30-35 percent by weight or ≧40-50 percent by weight through the additives in accordance with the invention which include high fractions of chemically bound water or calcinating constituents. Where appropriate also ≧75 percent by weight or approx 100 percent by weight of the alloy constituents may be supplied through the additives which are used in accordance with the invention.

Depending on the size of the melting vessel or converter, the stream of additives may amount to ≧100 kg/min, preferably 200-500 kg/min or even more, respectively referred to a melt of 100 to 120 tons metal weight (i.e. without slag weight), which analogously applies also to higher melting masses.

Supplying highly water-containing additives in accordance with the invention has proved particularly with regard to nickel and/or cobalt-containing additives, without being limited to the same. Accordingly, the following description refers to Ni-containing additives. It will be understood that, unless otherwise stated, this analogously applies to Co-containing or other additives containing different main alloy constituents, for instance Mn, Mo or Cr.

Accordingly, the additive which has to be used in the process according to the invention may be obtained by dissolving or leaching-out the relevant alloy constituents, particularly transition metals, from an ore, from a suitably processed ore or generally from a product which contains the alloy constituents and which may for instance be a waste material. After having transferred the respective alloy constituent, of which the content has to be increased in the metal melt, into the dissolved state the same may be precipitated by appropriate agents, for instance by alkaline agents such as MgO, CaO, dolomite etc., which may be used as a slurry where appropriate, ammonia or ammonium salts and/or carbonate or the like. Depending on the respective application, the precipitation may take place at increased temperatures or at room temperature and in exceptional cases also under cooling. Accordingly, the resulting precipitate may be a water-containing hydroxide, carbonate or a mixed hydroxide/carbonate. Normally the precipitation of the transition metal forming the alloy constituent takes place without the use of S-containing precipitation agents or without agents which lead to an S-introduction into the precipitate to be obtained. Accordingly, the alloy constituent is normally precipitated in such a form that the resulting additive overwhelmingly or practically exclusively consists of constituents which during the calcination of the additive when the same is transferred to the upper space of the melting vessel release apart from the alloy constituent overwhelmingly or practically exclusively volatile components such as $H_2O$, $CO_2$ etc., which are harmless compared to S-containing gases like $SO_2$ from the melting metallurgical aspect, and/or slag-forming components.

Where appropriate the solution containing the alloy constituent may be processed after dissolving or leaching the ore or another suitable material, in order to remove certain components like impurities. It will be understood, that the enrichment of the transition metal from the respective source may in case be effected in a different way, for example by extraction processes, though the same are less preferred.

Thereafter, the additive may be treated in such a way that it can be conveyed pneumatically or by gravity. To this end, the additive may include a residual humidity in physically bound water of ≦5 percent by weight, preferably ≦1 to 3 percent by weight. It will be understood, that the residual humidity to be adjusted is dependent on the respective conditions of the process.

The additive which is ready for being used may have a content of ≧10-15 percent by weight, ≧15-20 percent by weight or also ≧25-30 percent by weight of metallurgically harmless components such as $H_2O$ and/or $CO_2$ which are volatile during the calcination, for instance also ≧30-35 percent by weight or ≧35-40 percent by weight. The content of these components preferably is ≦65-70 percent by weight, e.g. ≦60-65 percent by weight, ≦55-60 percent by weight or ≦55-60 percent by weight. Here, the chemically bound water may be present particularly in the form of crystal water and/or hydroxide groups. Where appropriate, the additive may be pre-calcinated for already removing for instance a part of the chemically bound crystal water, although such a step is not necessarily required. The aforementioned facts may respectively apply also generally within the scope of the present invention.

Particularly preferred is an essentially metallic constituent or main constituent of the additive, of which the content has to be increased in the metal melt, at least one or more transition metals. The transition metal with the highest content or the transition metals may be present individually or altogether at an amount of ≦60-70 percent by weight, referred to the total metal content of the additive, wherein in this case all the metals, inclusive of Fe and slag-forming metals like Ca, Mg etc. are comprised. The transition metal or metals are preferably those metals which represent reducible oxides under the present conditions of the process when in contact with the melt or after the introduction into the melt, so that the at least one transition metal merges into the melt in a metallic form, by a melting metallurgical reaction with the melt. Accordingly, the melt acts reductively on the transition metal oxide which is generated by the calaination of the additive, or possibly it acts reductively on the additive itself. Preferably, the transition metal which is pre-sent in an oxidic and/or metallic form exhibits a steam pressure which is not excessively high or which may practically be neglected, so that losses caused by evaporating metal and/or metal oxide are avoided or kept small. This also comprises losses which are caused by a material discharge of the metal oxide or also of the additive itself due to the escaping calcination gases. An essential constituent or a main constituent of the additive may be at least one transition metal like for instance Ni, Co, V, Mo, Mn, Cr, Ti, Zr, W, Nb, Ta or combination thereof, and preferably the transition metal is Ni, Co, Mo or V, especially Ni or Mo. Where appropriate, Ni and Co may be present in combination, wherein Ni or Co can be the main constituent.

For the production of nickel and/or cobalt-containing additives it is particularly advantageous to apply leaching of laterite ores or laterite-like ores, e.g. saprolite. But preferred is the product which is weathered the most, namely laterite. In lateritic nickel ores two kinds may be differentiated, namely Ni-limonite ore which is very rich in iron with 1 to 2 percent by weight of nickel, bound to goethite, or nickel-silicate ores which frequently contain more than 2 percent by weight of nickel which in silicates is especially bound to serpentine. It will be understood that also other transition metals, other suitable sources and particularly also ores may be used.

For leaching Ni/Co, acids may be used in particular, for instance sulfuric acid. The leaching is effected preferably by heap leaching. The leaching may be normally performed at atmospheric pressure or at an increased pressure, for instance by high pressure acid leaching. Where appropriate also other processes such as biological leaching processes, ammonium/ammoniac leaching and the like may be used. This may generally apply also to other transition metals which are obtained from ores or other sources. Preferably, the leaching is performed without the use of sulfides and/or chlorides, which fact may also apply to other method steps for the production of the additive.

From the resultant solution or leach cobalt may be separated before by suitable methods, for example by means of suitable complexing agents like phosphonic acids etc. This generally applies also to the separation of other undesired components as well as undesired alloy constituents, both for the production of Ni-containing additives or also other additives containing transition metals. If necessary, nickel and cobalt may thereafter be leached also in common, for producing so-called mixed precipitates (MHP). This analogously applies to other mixed transition metal precipitates.

The nickel-containing additive may have a nickel content of ≧5-10 percent by weight, for instance ≧15 to 17 percent by weight or ≧20 to 23 percent by weight, where appropriate also ≧25 to 27 percent by weight, inclusive of the content of residual humidity or respectively referred to a substance having a residual humidity of approx 0 percent by weight. The nickel content typically is ≦50-55 percent by weight or also ≦40-45 percent by weight, but it may also amount up to approx 60-65 percent by weight or higher. These specifications relate to the additive which is to be used in the melting metallurgical process. This may correspondingly apply also to Co-containing additives or other additives with transition metals of the first transition metal period like V etc., inclusive of mixed additives with two or more alloy constituents like No/Co additives, and corresponding facts apply to transition metals of higher periods like for instance Mo, in consideration of the relationship of the atomic weights of the transition metal of the higher period to that of the first period like for instance Ni.

The following specifications particularly relate to a Ni/Co-containing additive which is produced especially by laterite leaching. But these specifications may also be generally valid within the scope of the invention.

The additive may be chemically bound water in the form of crystal water and/or hydroxide groups at a fraction of ≧5-10 or up to 11 percent by weight or ≧15 to 21 percent by weight, possibly also ≧25 to 30 percent by weight or ≧35-40 percent by weight, which may also generally apply to additives that can be used within the scope of the invention. Preferably, the additive does not contain more than 50-55 percent by weight or 60-65 percent by weight of water (inclusive of water in the bound form). If the additive is present as a carbonate or mixed hydroxide/carbonate, the respective content is correspondingly valid for the content of $CO_2$ and/or chemically bound water.

The sulfur content of the additive preferably amounts to ≦5-10 percent by weight, in particular ≦4 percent by weight or ≦2-3 percent by weight. Preferably the sulfur content is ≦0.5-1 percent by weight or ≦0.2-0.3 percent by weight. This may analogously apply also to the content of Cl and may also be generally true within the scope of the invention.

If the additive shall serve alone for alloying nickel, vanadium and/or molybdenum in the melt, the Co-content preferably amounts to ≦2.5-2 percent by weight, ≦1.75-1.5 percent by weight or ≦1.25-1 percent by weight. This especially applies where the additive serves for alloying nickel and where e.g. nickel is present as a main constituent. The Co-content is therefore noncritical with regard to other Co-sources of the melt, so that with respect to the amount at which the additive may be used in the respective process no restrictions are given for avoiding un-desirably high Co-contents.

Preferably the content of P, Cu, Sn, Pb, Nb, As, Cd and/or Pd in the additive is limited to such values that the amount of the additive to be added to the respective melt is not limited, in order to be able to keep the upper limits of the specified components in the melt. If it is only Ni which is to be alloyed by the additive, this will also apply to the components Co, V, Mo and vice versa. Due to the fact that the additive may be obtained through an aqueous solution of the respectively desired transition metal, the contents of the stated components may be comparatively easily controlled by known measures.

In addition to the main alloy constituent the additive may contain further alloy constituents such as e.g. cobalt (in the case of a Ni additive) or nickel (in the case of a Co additive), manganese etc., if these elements are desired for the respective intended use or are not disturbing. In the case of a Ni and/or Co-containing additive obtained from leaching laterite there may be further contained manganese (e.g. ≧0.25 to 5 percent by weight or ≧1 to 2 percent by weight), where the content may be ≦7.5 to 10 percent by weight or ≦5 percent by weight, cobalt at fractions of ≧0.1 to 0.25 percent by weight or ≧0.75 percent by weight, where the cobalt content may be ≦3 to 5 percent by weight or ≦2 percent by weight. The content of alloy formers including iron may in this case be ≧1 to 2 percent by weight or ≧3 percent by weight and may be ≦15 percent by weight, ≦10 to 12 percent by weight or also ≦8 to 10 percent by weight. This may also be generally true within the scope of the invention.

The additive may further contain slag-forming constituents like Ca, Mg. The content of the slag-forming constituents or the content of Ca and/or Mg in the additive may be ≧0.5 to 1 percent by weight or 1.5 to 2 percent by weight, for instance ≧3 to 5 percent by weight, referred to the additive which is free of residual humidity and respectively referred to the weight of the metal. The slag-forming constituents or Ca and/or Mg may be present in a form suitable for the melting metallurgical process, e.g. as an oxide, hydroxide and/or carbonate, but also silicate. The content of slag-forming constituents may be ≦25 percent by weight or ≦15 to 20 percent by weight, particularly ≦10 to 12 percent by weight or ≦6 to 8 percent by weight, referred to the additive without residual humidity that is to be used in the process. The stated contents may be respectively inclusive or exclusive Mn, Cr, Si, Ti, Si and/or Fe. The aforementioned facts may also generally apply within the scope of the invention.

In the following the invention will explained by way of a preferred embodiment.

FIG. 1 is a schematic illustration of the melting vessel (converter), according to an embodiment of the invention, including a feeding device for the additive in the form of a lance.

FIG. 1 shows an arrangement for carrying out the process according to the invention, wherein a metal melt 2 is provided in a melting vessel 1 which is e.g. in the form of a converter, and wherein the metal melt 2 is covered with a slag 3. The melt may represent an iron alloy, e.g. one for the production of a Ni-alloyed steel having a Ni content of 1.5 to 30 percent by weight, especially for the production of usual Ni or Cr/Ni steels like 18/8 Cr/Ni steel and/or steels having a P and S content respectively of ≦0.005 percent by weight or ≦0.0035 percent by weight, which may apply independently of the embodiment. Here, the slag represents a slag which is usual for the production of the respective alloy, for instance containing high fractions of chromium oxide, MgO, CaO and/or SiO2, and which in addition to covering the melt may interfere in the metallurgy of the melt.

As a feeding device for introducing the additive into the melt a preferably water-cooled lance 4 is provided above the slag which penetrates preferably into the upper part of the melting vessel 1. Said lance 4 consists of a central tube 5 for nozzle injecting the solid additive into the melt, which central tube is surrounded on the outside thereof by an external tube 6 or by a plurality of single tubes, for instance ≧2-3 or ≧4-6 single tubes, circumferentially arranged around the said central tube. The tube ends may be provided with nozzle-like discharge openings, e.g. in the form of Laval nozzles, in order to be able to inject the additive through nozzles into the melt at a high speed, preferably supersonic speed. Accordingly, the solid, pneumatically conveyable additive is injected in case by means of a suitable conveying gas such as oxygen through the central tube into the melt, through the external tubes 6 a gas stream is ejected towards the metal melt, which gas stream surrounds and focuses the solid material stream 8 leaving the central tube 5. Here the gas jacket 7 serves on one side for materially shielding the solid material stream 8 against the surroundings and further to focus the same especially with regard to the high fraction of volatile matter which is produced during the calcination of the additive. In particular, the gas stream also serves for completely or almost completely penetrating through the slag, thereby producing a slag-free burn spot 9 where the metal melt 2 is hence exposed. The temperature of the melt in the region of the burn spot may be for example 2, 400 to 2,600° C.

The additive is injected through the nozzles into the melt at a speed which is high to an extent that a calcination of the additive takes place at the time of or after the exit of the additive from the lance, under separation of $H_2O$, $CO_2$ and in case also of other volatile matter. Because of the high ambient temperatures, e.g. the radiation heat from the wall 1*a* of the melting vessel, from the metal melt and the like, the decomposition of the additive takes place predominantly or completely on the way from the lance nozzle 4*a* to the melting bath. Possible non-calcinated fractions of the additive are calcinated in the burn spot 9 or in the impact zone 10 on the metal melt. Accordingly, during the calcination all the volatile matter such as $H_2O$, $CO_2$ and the like are volatilized, so that only the non-volatile substances like metal oxides enter into the melt and become absorbed by the melt.

The gas which is passed along with the solid material stream through the central tube 5 may be air, a gas which is oxygen-deriched compared to air, or an inert gas. The enveloping gas passed through the external tubes 6 may represent air, a gas which is oxygen-enriched compared to air, or pure oxygen or an inert gas or mixtures thereof. The oxygen content has to be adapted to the respective conditions of the process like for instance the heat budget of the melting metallurgical process. Where appropriate, further solid materials like alloy constituents, slag formers or the like may supplied to the melt along with the additive stream, though this is not necessarily required. Preferably, the additive stream does not contain reduction agents like carbon, ferrosilicon, aluminium or the like. The process according to the invention may represent particularly an AOD process, where appropriate also an electro metallurgical process.

Surprisingly it turned out that the supply of additives for the adjustment of the alloy content of the melt is possible under the use of highly water-containing substances, whereby the production cost of the respective alloy can be clearly reduced, especially as the additive can be produced at low cost and additional expensive steps like a treatment of the slag for reducing the sulfur content of the melt etc. can be avoided. Such a process management is given especially by the fact that the additive is directly injected through nozzles into the very hot, slag-free burn spot.

The additive may be obtained in particular by laterite leaching, for instance by leaching by means of sulfuric acid at atmosphere pressure or at an increased pressure, but in case also by other leaching processes. From the acidic leach the nickel-containing additive may then be precipitated through suitable precipitation agents like a MgO and/or CaO-slurry, by the addition of carbonates like sodium carbonate, calcium carbonate, dolomite etc., by the addition of ammoniac or ammonium compounds to produce essentially a nickel hydroxide, nickel carbonate or mixed nickel hydroxide/carbonate. The conversion with the precipitation agent may take place at increased temperatures, for instance at 30-80° C. or higher, in suitable time periods from e.g. some minutes up to 1 hour. Where appropriate, cobalt may be separated by suitable processes such as for instance extraction processes in a preceding step of the process.

The additive may be pre-dried for a residual humidity which permits a pneumatic conveyance of the additive. In this case, the residual humidity is understood to be physically bound water which may be removed at temperatures of ≦120 to 150° C. within a suitable period of time, for instance within one to two hours. The additive may be treated so that it is suitable for conveyance by gravity.

If need be, the additive may be mechanically treated in order to obtain a suitable grain size or dissipation, and in case it may also be compacted or agglomerated.

In the case of a nickel-containing additive the nickel content thereof is typically approx 15 to 55 percent by weight, especially approx 20 to approx 40 percent by weight, referred to the pre-dried additive (without residual humidity). The content of chemically bound water in the form of crystal water and/or hydroxide groups typically is 30 to 50 percent by weight or also 40 to 50 percent by weight. It will be understood that the additive may possibly be pre-calcinated at higher temperatures, in order to decrease the water and/or carbonate content, though this is not necessarily required.

In the following two typical analyses of the nickel-containing additive are given. The products were each obtained by laterite leaching by means of an 80% sulfuric acid at 90° C. for 0.5 hours (approx 20 g of ore, suspended in 80 g of water; 100 g of sulfuric acid). Leaching times <1 or <0.75 hours generally proved advantageous. The leach was partially neutralized by means of dolomite and thereafter mixed with a MgO-slurry to produce a nickel hydroxide precipitate.

The precipitate that was filtered off was dried for a residual humidity of approx 1.5 percent by weight (at 120° C. for 2 hours), the content of chemically bound water was 55 percent by weight (composition 1) respectively 45 percent by weight (composition 2), each calculated as the weight loss of the material dried for a residual humidity of approx 0 percent by weight after a thermolysis at 750° C. for 4 hours until weight constancy. It will be understood that the thermolized material may still contain a content of carbonate or other constituents which decompose only at higher temperatures.

It will be understood that the composition of the additive may vary depending on the ore that is used or the nickel-containing base product. The following analysis details are related to a material which was dried at 120° C. for two hours to obtain a residual humidity of approx 0 percent by weight (i.e. crystal water inclusive).

| Composition 1 (data in percent by weight) | |
|---|---|
| Ni | 24 |
| Al | 0.75 |
| Ca | 0.75 |
| Co | 1.5 |
| Cr | <0.05 |
| Fe | 0.75 |
| Mn | 4.0 |
| Mg | 6.0 |
| Water content (crystal water) | 50 |

| Composition 2 (data in percent by weight) | |
|---|---|
| Ni | 38 |
| Al | <0.05 |
| Ca | 2 |
| Co | 0.5 |
| Cr | <0.05 |
| Fe | 2.5 |
| Mn | 1.5 |
| Mg | 2.5 |
| Water content (crystal water) | 40 |

It will be understood that except of ores also other substances may be generally used for the production of the additives used in accordance with the invention, from which nickel-containing or generally transition metal-containing additives can be produced in a corresponding manner and with which the transition metals can be obtained by a suitable leaching on the basis of a water-containing leaching agent.

Further, it will be understood that the process according to the invention is not limited to the use of Ni/Co-containing additives, but that also other alloy constituents, especially transition metals like Mo, V or the like may be added to the melt in a corresponding form. In this case, the additives are respectively injected through nozzles into the melting vessel and the metal melt having a very high temperature preferably from the upper side of the melting vessel and, in the case of melts which are covered with a slag, into a slag-free burn spot.

The invention claimed is:

1. A process for producing a metal melt containing at least one base metal and at least one alloy constituent, wherein the production takes place in a melting vessel with slag covering the melt, the method comprising feeding an additive containing the alloy constituent to the melt by a feeding device, the alloy constituent being a transition metal and the additive being in the form of a solid, wherein the additive contains 10 to 70 percent by weight of the alloy constituent, 20 to 70 percent by weight of at least one of $H_2O$ and $CO_2$ which is/are volatilized by calcination during feeding of the additive to the melt, ≦5 percent by weight of sulfur, and 0.5 to 20 percent by weight of slag formers containing at least one of Ca and Mg, and wherein the additive is directly fed to the metal melt by a gas stream sufficient to penetrate through the slag to form a slag-free burn spot of the slag-covered melt, the slag-free burn spot having a temperature of 2,000° C. to 2,600° C.

2. Process according to claim 1, wherein the additive which contains the alloy constituent is directly supplied to the metal melt by a gas stream under the formation of a slag-free burn spot of the slag-covered melt.

3. Process according to claim 1, wherein the additive is fed to the melt in such a way that a calcination or decomposition of the additive takes place only at the time of or after exiting from the feeding device and prior to or during impinging upon the metal melt or within an impact zone.

4. Process according to claim 1, wherein the additive is supplied to the melt in a solid material stream which is surrounded by a gas stream.

5. Process according to claim 4, wherein the gas stream has an oxygen content of ≧25 percent by weight.

6. Process according to claim 4, wherein the gas stream contains ≧75 percent by weight of at least one inert gas.

7. Process according to claim 4, wherein the solid material stream contains further alloy constituent-containing additives and/or further alloy constituents and/or slag-forming substances.

8. Process according to claim 4, wherein the solid material stream contains ≦10 percent by weight of reduction agents, selected from carbon, carbon hydroxides and ferrosilicon.

9. Process according to claim 1, wherein the alloy constituent is the main constituent of the additive and 5 to 10 percent by weight of the alloy constituent is supplied to the melt via the additive.

10. Process according to claim 1, wherein the additive contains nickel and/or cobalt as the main alloy constituent.

11. Process according to claim 1, wherein the additive is includes a salt containing crystal water, hydroxide, carbonate or mixed hydroxide/carbonate.

12. Process according to claim 1, wherein the additive consists of ≧70 percent by weight of the alloy constituent, the at least one of $H_2O$ and $CO_2$, and the slag formers.

13. Process according to claim 1, wherein the metal melt is produced using an argon-oxygen-decarburization (AOD) process.

14. Process according to claim 1, wherein the melting vessel is an argon-oxygen-decarbonizer, a Creusot-Loire-Uddeholm (CLU) converter, a vacuum-oxygen (VOD) converter, a BOP converter, or a Q-BOP converter.

15. Process according to claim 1, wherein the additive is fed to the melt during a (i) decarburization process performed by a blowing lance or (ii) during a refining process or (iii) directly before or after a decarburization or refining process.

16. Process according to claim 1, wherein a carbon content of the melt during feeding of the additive to the melt is 2 to 10 percent by weight.

17. Process according to claim 1, wherein the additive is fed to the metal melt at a rate in the range of 100 to 500 kg/min when a metal melt weight is in the range of 100 to 120 tons.

18. A process for producing a metal melt containing at least one base metal and at least one alloy constituent, wherein the production takes place in a melting vessel with slag covering the melt, the method comprising feeding an additive containing the alloy constituent to the melt by a feeding device, the alloy constituent being a transition metal and the additive being in the form of a solid, wherein the additive is a transition metal hydroxide, a transition metal carbonate, or a mixture thereof;

wherein the additive contains 10 to 70 percent by weight of the alloy constituent, 20 to 70 percent by weight of at least one of $H_2O$ and $CO_2$ which is/are components of the transition metal hydroxide, transition metal carbonate, or mixture thereof, and which is/are volatilized by calcination during feeding of the additive to the melt, ≦5 percent by weight of sulfur, and 0.5 to 20 percent by weight of slag formers containing at least one of Ca and Mg; and wherein the additive is directly fed to the metal melt by a gas stream sufficient to penetrate through the slag to form a slag-free burn spot of the slag-covered melt, the slag-free burn spot having a temperature of 1,750° C. to 2,600° C.

19. A process for producing a metal melt containing at least one base metal and at least one alloy constituent, wherein the production takes place in a melting vessel with slag covering the melt, the method comprising feeding an additive containing the alloy constituent to the melt by a feeding device, the alloy constituent being a transition metal and the additive being in the form of a solid, wherein the additive is a transition metal hydroxide, a transition metal carbonate, or a mixture thereof;

wherein the additive contains 10 to 70 percent by weight of the alloy constituent, 20 to 70 percent by weight of at least one of $H_2O$ and $CO_2$ which is/are components of the transition metal hydroxide, transition metal carbonate, or mixture thereof, and which is/are volatilized by calcination during feeding of the additive to the melt, ≦5 percent by weight of sulfur, and 0.5 to 20 percent by weight of slag formers containing at least one of Ca and Mg;

wherein the additive is directly fed to the metal melt by a gas stream sufficient to penetrate through the slag to form a slag-free burn spot of the slag-covered melt, the slag-free burn spot having a temperature of 1,750° C. to 2,600° C.; and wherein the additive is fed to the metal melt at a rate in the range of 100 to 500 kg/min when a metal melt weight is in the range of 100 to 120 tons.

20. A process for producing a metal melt containing at least one base metal and at least one alloy constituent, wherein the production takes place in a melting vessel with slag covering the melt, the method comprising feeding an additive containing the alloy constituent to the melt by a feeding device, the alloy constituent being a transition metal and the additive being in the form of a solid, wherein the additive is a transition metal hydroxide, a transition metal carbonate, or a mixture thereof;

wherein the additive contains 10 to 70 percent by weight of the alloy constituent, 20 to 70 percent by weight of at least one of $H_2O$ and $CO_2$ which is/are components of the transition metal hydroxide, a transition metal carbonate, or a mixture thereof, and which is/are volatilized by calcination during feeding of the additive to the melt, ≦5 percent by weight of sulfur, and 0.5 to 20 percent by weight of slag formers containing at least one of Ca and Mg;

wherein the additive is directly fed to the metal melt by a gas stream sufficient to penetrate through the slag to form a slag-free burn spot of the slag-covered melt, the slag-free burn spot having a temperature of 2,000° C. to 2,600° C.; and wherein the additive is fed to the metal melt at a rate in the range of 100 to 500 kg/min when a metal melt weight is in the range of 100 to 120 tons.

21. A process for producing a metal melt containing at least one base metal and at least one alloy constituent, wherein the process is an electro-steel process and wherein the production take place in a melting vessel, the method comprising feeding an additive containing the alloy constituent to the melt by a feeding device, the alloy constituent being a transition metal and the additive being in the form of a solid, wherein the additive is a transition metal hydroxide, a transition metal carbonate, or a mixture thereof;

wherein the additive contains 10 to 70 percent by weight of the alloy constituent, 20 to 70 percent by weight of at least one of $H_2O$ and $CO_2$ which is/are components of the transition metal hydroxide, a transition metal carbonate, or a mixture thereof, and which is/are volatilized by calcination during feeding of the additive to the melt, ≦5 percent by weight of sulfur, and 0.5 to 20 percent by weight of slag formers containing at least one of Ca and Mg; and wherein the additive is directly fed to the metal melt by a gas stream into a burn spot having a temperature of 2,000° C. to 2,600° C.

* * * * *